US007497222B2

(12) United States Patent
Edwards et al.

(10) Patent No.: US 7,497,222 B2
(45) Date of Patent: Mar. 3, 2009

(54) COMMINUTION DEVICE AND METHOD FOR COMMINUTING RESIDUE IN A DISHWASHER

(75) Inventors: James Michael Edwards, Newport, NC (US); Rüdiger Eiermann, Syrgenstein (DE); Steffen Hörandel, Heidenheim (DE); Michael Rosenbauer, Reimlingen (DE); Hans-Dieter Rossteuscher, Hürben (DE)

(73) Assignee: BSH Bosch und Siemens Hausgeraete, Munich (DE)

( * ) Notice: Subject to any disclaimer, the term of this patent is extended or adjusted under 35 U.S.C. 154(b) by 675 days.

(21) Appl. No.: 10/882,197

(22) Filed: Jul. 2, 2004

(65) Prior Publication Data

US 2006/0000496 A1 Jan. 5, 2006

(51) Int. Cl.
*B08B 3/00* (2006.01)

(52) U.S. Cl. ..... 134/111; 134/115 G; 134/186

(58) Field of Classification Search ..... 134/94.1, 134/110, 111, 115 G, 186
See application file for complete search history.

(56) References Cited

U.S. PATENT DOCUMENTS 3,064,664 A * 11/1962 Warhus ..... 134/176
4,350,306 A * 9/1982 Dingler et al. ..... 241/46.012
5,628,334 A * 5/1997 Edwards et al. ..... 134/104.1
2005/0005952 A1 * 1/2005 Bashark ..... 134/18
2006/0237035 A1 * 10/2006 Ferguson et al. ..... 134/10
2007/0107753 A1 * 5/2007 Jerg ..... 134/56 D

* cited by examiner

*Primary Examiner*—Michael Barr
*Assistant Examiner*—Rita R Patel
(74) *Attorney, Agent, or Firm*—Russell W. Wamock; James E. Howard

(57) ABSTRACT

A dishwashing machine including a comminution device and a method for comminuting residue in the dishwasher. The comminution device at minimal manufacturing costs, makes it possible to easily comminute the coarse contaminants or residue accumulating during the rinse cycle in the dishwashing machine, flush it out of the dishwasher and at the same time reduce the danger of clogging the sieve(s) placed in the dishwasher. The comminution device preferably is actuated by the lye pump of the dishwashing machine. In this manner the comminution device is actuated easily and efficiently, which both enables cost-effective manufacture of the dishwashing machine, and improves its operating safety and ease of maintenance. In the process the rinse residue can first collect during the rinse cycle in uncomminuted form on the floor of the rinsing container and only then be comminuted when the washing liquid is pumped out and flushed out of the dishwashing machine.

34 Claims, 2 Drawing Sheets

COMMINUTION DEVICE AND METHOD FOR COMMINUTING RESIDUE IN A DISHWASHER

BACKGROUND OF THE INVENTION

Field of the Invention

The present invention generally relates to dishwashers and, in particular, to a dishwasher with a device for comminuting rinse residue.

When dishes are washed in a dishwasher rinse residue usually accumulates, which collects at the bottom of the dishwasher. A portion of the rinse residue is often too coarse or too heavy, so that it cannot be flushed away via the lye or rinse discharge pump and out of the dishwasher along with the used rinsing water after the rinse cycle. As a consequence, this coarse rinse residue lodges in the transport paths of the washing liquid or loads the sieves or filters situated in the dishwasher, which can considerably impair the operation of the dishwasher.

In an attempt to eliminate this problem sieve or filter devices are already known, which filters can be removed from the dishwasher, cleaned and replaced. The disadvantage of such sieve or filter devices is that the cleaning cycle is inconvenient for the user. Also, the cleaning cycle is often forgotten or executed all too infrequently, such that trouble-free operation of the dishwasher is no longer guaranteed on account of the sieve devices becoming clogged and consequently impeding the transport paths of the washing liquid, and this disadvantageously impairs the rinsing result and in the extreme case can lead to major damage to the dishwasher itself.

In known dishwashers a comminution device (or chopper) is provided, by which the rinse residue accumulating during the rinse cycle in the dishwasher can be reduced in size to the extent that it can be flushed away out of the dishwasher in the comminuted state along with the used rinsing water via the lye or discharge pump. But the disadvantage of known comminution devices is that in many cases, they are driven by an additional separate motor. Since the motors are one of the most cost-intensive components in a dishwasher, they represent a large proportion of overall manufacturing costs of a dishwasher. Each additional motor consequently increases the manufacturing costs of a dishwasher as well as the danger of disruption to operation due to an additional motor driven component.

With other known dishwashing machines having comminution devices, the comminution device is driven via the circulating pump of the dishwashing machine. The disadvantage of the drive of the comminution device via the circulating pump, however, is that the comminution device is actuated only while the circulating pump is operating. Thus, comminution of the rinse residue occurs only during the rinse cycle, since during the pumping procedure, in which the used washing liquid is pumped out of the dishwasher via the lye pump, the circulating pump is generally idle. The added disadvantage here is that the rinse residue cannot accumulate in uncomminuted form on the floor of the rinsing container during the rinse cycle, but is comminuted while the circulating pump is operating and is recycled with the washing liquid.

BRIEF SUMMARY OF THE INVENTION

The present invention provides a dishwasher with a comminution device having a low manufacturing cost, which enables the coarse contaminants or residue accumulating during the rinse cycle to be comminuted easily in the dishwashing machine while the washing liquid is pumped and flushed out of the dishwasher. The present invention also reduces the danger of blocking of the sieves or filters located in the dishwasher, in particular in the vicinity of the siphon and the pipes for pumping out the washing liquid.

With the dishwasher of the present invention, a lye or discharge pump for pumping the washing liquid out of the dishwasher and a comminution device for comminuting rinse residue are provided, whereby the comminution device is driven by the lye pump.

The advantage of the dishwasher with a comminution device according to the present invention is that the comminution device is driven simply and efficiently, which both enables cost-effective manufacturing of the dishwasher and also improves the operating safety of the dishwashing machine. Through the drive of the comminution device via the lye pump, the accumulating coarse contaminant or residue in the dishwashing machine is comminuted to the extent where it can be flushed out of the dishwashing machine along with the used washing liquid. In this way both the rinse result and the ease of maintenance of the dishwashing machine are improved.

The added advantage of the dishwasher with a comminution device according to the present invention is that the comminution device is actuated only when the lye pump is operating and thus the rinse residue is comminuted not during the rinse cycle, but only during the pumping cycle, in which the used washing liquid is pumped out of the dishwasher via the lye pump. The consequence of this is that the rinse residue can accumulate during the rinse cycle in uncomminuted form on the floor of the rinsing container and not be comminuted while the circulating pump is operating and recycled with the washing liquid. Thus the danger of blocking the sieves or filters in the dishwasher, in particular in the transport paths of the washing liquid as well as in the vicinity of the siphon and the pipes for pumping out the washing liquid is lowered. It is also possible to easily outfit a dishwashing machine with a comminution device according to the present invention.

The comminution device includes for example a comminuting cutter or a number of comminuting cutters, which are set in motion by the lye pump, preferably in a rotation motion at high revolution, in order to comminute the accumulated rinse residue. In its comminuted form the rinse residue can then be flushed out via the lye pump when the used washing liquid is pumped out of the dishwasher.

In a particularly advantageous embodiment of the present invention the comminution device is disposed inside an outlet channel, through which the washing liquid is pumped out of the dishwasher. The outlet channel is located between the rinsing container of the dishwashing machine and the discharge pipe, via which used washing liquid is flushed out of the dishwasher, so that the washing liquid must pass through the comminution device in any case during the pump cycle, whereby the rinse residue carried along therewith is comminuted.

To ensure that no rinse residue passes through the comminution device uncomminuted, a sieve or filter can be arranged in the outlet channel behind the comminution device, with respect to the direction of flow of the washing liquid. The sieve holds back coarse rinse residue, which flows through the outlet channel with the used washing liquid during the pump cycle, until it has been sufficiently comminuted by the comminution device that it can pass through the sieve and be flushed out via the discharge pipe. This effectively prevents the discharge pipe being clogged by coarse rinse residue.

In a further advantageous embodiment of the present invention with respect to the direction of flow of the washing liquid in the outlet channel the sieve is arranged behind the comminution device and is designed as a matrix, which cooperates with the comminution device, to comminute the rinse residue in the outlet channel. In addition, the sieve designed as a matrix can have a lattice structure, which is formed out of a resistant material and with sharp edges, which cooperate with the comminution device to comminute the rinse residue. Preferably, at least the lattice structure of the sieve designed as a matrix essentially is formed from metal, so that the sharpness of the edges remain intact over a long operating life.

The comminution device and the sieve designed as a matrix cooperate for example such that the comminuting cutters of the comminution device rotate only at a slight distance from the sieve, whereby the rotation plane of the comminuting cutter is aligned substantially parallel to the plane of the sieve. But the sieve can also be configured such that the comminuting cutters are in contact with the sieve and the comminuting cutters pass over the sieve during its rotation motion. In this way the rinse residue between the comminuting cutter and the sieve are cut up evenly by the cooperation between the cutting edge of the rotating comminuting cutters and the sharp edges of the fixed sieve.

It is of particular advantage when the drive of the comminution device occurs by way of the impeller of the lye pump. Via the impeller of the lye pump the washing liquid is transported out of the dishwashing machine, that is, it is pumped out via the outlet channel in the waste water channels provided therefor. As a result, the impeller of the lye pump turns at high revolution. Since the comminution device also is operated preferably at high revolution to achieve a satisfactory comminution effect, the impeller of the lye pump is particularly suited to the drive of the comminution device, without a gear having to be provided between them.

The drive between the comminution device and the lye pump is preferably produced by means of a rigid drive shaft. This can create both a structural distance between the comminution device and the lye pump, and also provides power transfer with the least possible loss. At the same time the drive shaft is appropriately coupled between the comminution device and the lye pump on the hub of the impeller of the lye pump.

The present invention will now be explained in greater detail herein below in terms of an embodiment with reference to the diagram. The diagram shows a schematic representation of the essential components of a comminution device, as it can be arranged in a dishwasher according to the present invention.

DETAILED DESCRIPTION OF THE INVENTION

Figure 1:
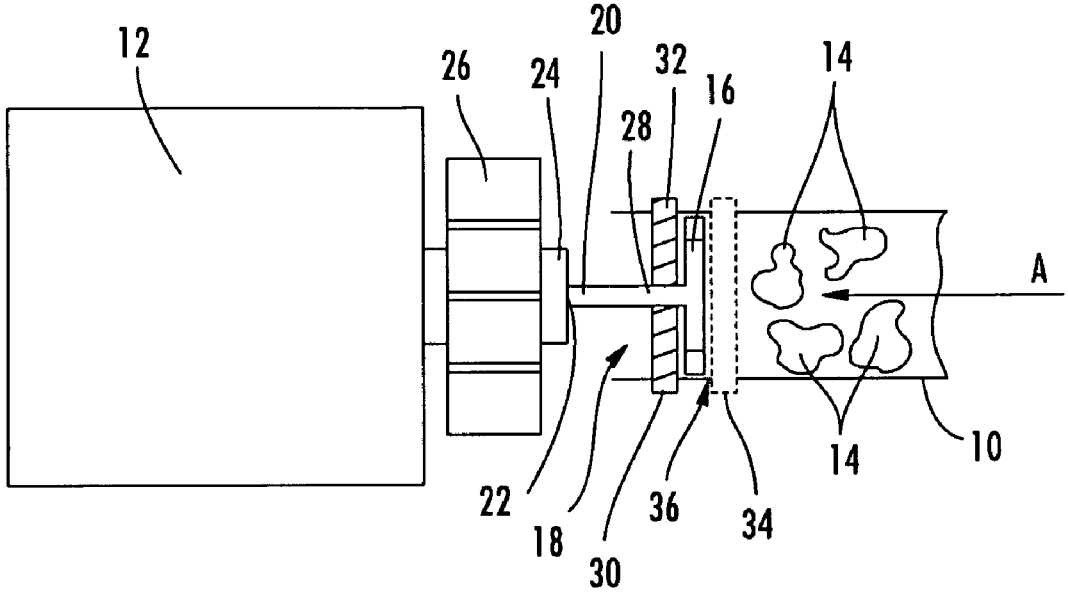
FIG. 1 illustrates a schematic and diagrammatic representation of the essential components of a comminution device of the present invention.
Figure 2:
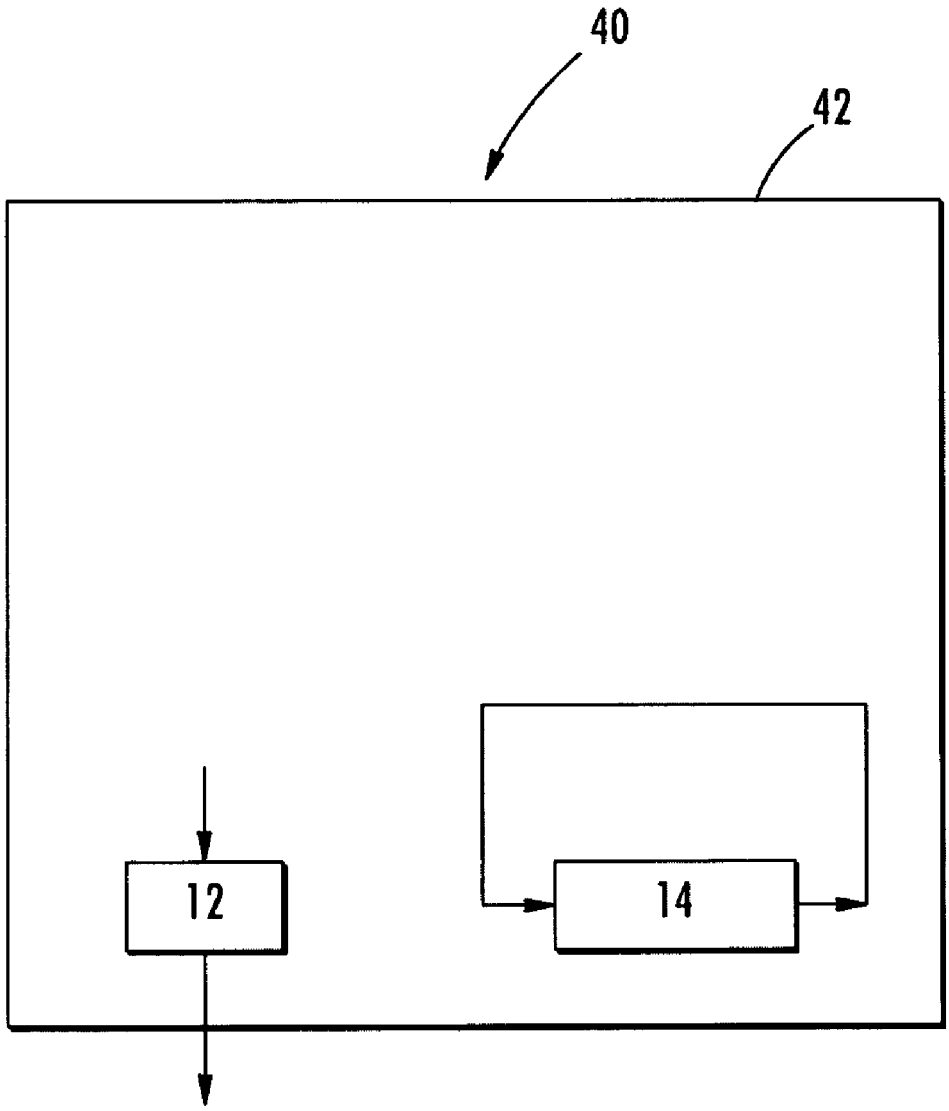
FIG. 2 illustrates a schematic representation of a dishwasher 40 in accordance with an exemplary embodiment of the present invention.

In general a dishwashing machine 40 (FIG. 2) has a rinsing container 42, containing the dishes and which is closed off downwards by a pump top (not illustrated). During the rinse cycle the washing liquid in the rinsing container flows down and collects on the floor of the pump top. From there the washing liquid is either pumped during the rinse cycle by the circulating pump 44 back into the transport paths for the washing liquid, or is flushed through an outlet channel 10 via a lye or discharge pump 12 out of the dishwasher during the pump cycle via a discharge pipe (not illustrated) in a conventional manner.

During the course of the pre-rinse phase and the cleaning cycles, a coarse rinse residue 14, which cannot be flushed out of the dishwasher via the lye pump 12 in the discharge pipe as the used washing liquid is being pumped out, collects in the lower region of the pump top and in the outlet channel 10. Located in the outlet channel 10 are a plurality of comminuting cutters 16 of a comminution device 18, which can be set in a rotation motion by the lye pump 12 at a high rotation, in order to comminute the accumulated rinse residue 14. In comminuted form the rinse residue 14 can then be flushed out of the dishwasher through the outlet channel 10 via the lye pump 12 as the used washing liquid is being pumped out in the discharge pipe.

The comminution device 18 is actuated via a drive axle or shaft 20, having a first end 22 attached firmly to a hub 24 of an impeller 26 of the lye pump 12. The drive shaft 20 includes a second end 28, which projects into the outlet channel 10 and is fitted with the comminuting cutters 16. During the rinse cycle the lye pump 12 and thus also the comminution device 18 are idle. During the pump cycle, during which the lye pump 12 pumps the used washing liquid out of the dishwasher, the impeller 26 is actuated by the lye pump 12 and at the same time the same time is set in rotational motion at high revolution. This in a like manner causes the comminuting cutter or cutters 16 to also be set in the same rotation at high revolution by the direct coupling of the impeller 26 with the drive shaft 20.

In the Figure the direction of flow of the washing liquid in the outlet channel 10 during the pump cycle, is indicated by an arrow A. Arranged in the outlet channel 10, with respect to the direction of flow A of the washing liquid, behind the comminution device cutters 16 is a sieve or filter 30, which preferably is designed as a matrix. In the region through which washing liquid flows the matrix 30 also preferably has a lattice structure, which substantially is formed from metal or another resistant material and which is designed with sharp edges, which cooperate with the comminution device cutters 16 to comminute the rinse residue 14 in the outlet channel 10.

In the embodiment illustrated in the Figure, the comminution device 18 and the sieve 30 designed as a matrix cooperate such that the comminuting cutters 16 are in contact with the sieve 30 and the comminuting cutters 16 pass over a surface 32 of the matrix 30 during their rotation motion. In this way the rinse residue 14 is evenly cut up between the comminuting cutters 16 and the sieve 30 by the cooperation between the cutting edge of the rotating comminuting cutters 16 and the sharp edges of the fixed sieve 30.

A second wide-meshed sieve or filter 34 is arranged in the outlet channel 10, with respect to the direction of flow A of the washing liquid, before the comminution device 18. By means of the wide-meshed sieve 34 arranged before the comminution device 10, larger size particles of the rinse residue 14 can be held back until they has been adequately comminuted by the comminution device cutters 16. This happens by the comminution device 18 detecting and comminuting only those portions of the rinse residue 14, which project through the wide-meshed sieve 34 into a working area 36 of the comminution device 18. To the extent that the comminution device cutters 16 comminute those portions of the rinse residue 14 projecting through the wide-meshed sieve 34, more portions of the rinse residue 14 can penetrate the wide-meshed sieve 34 and enter the working area 36 of the comminution device 18. Then the rinse residue 14 which is thus pre-comminuted, is even further comminuted by cooperation between the comminution device 18 and the matrix 30, so that it also passes through the matrix 30 and can be flushed out by the lye pump 12 through the discharge pipe.

Having thus generally described the present invention, the same will become better understood from the appended claims in which the present invention is set forth in a non-limiting manner.

LIST OF REFERENCE NUMERALS

10 outlet channel
12 lye pump
14 rinse residue
16 comminution or comminuting cutters
18 comminution device
20 drive shaft of comminution device 18
22 drive shaft first end
24 hub
26 impeller
28 drive shaft second end
30 sieve or matrix
32 surface
34 second sieve or wide-meshed sieve
36 working area
A direction of flow of washing liquid in outlet channel 10

The invention claimed is:

1. A dishwasher, comprising a circulation pump for circulating washing liquid within the dishwasher;

a lye or discharge pump for pumping the washing liquid out of the dishwasher; and a comminution device for comminuting coarse rinse residue in said washing liquid as it is pumped out of said dishwasher; said comminution device driven by said lye pump.

2. The dishwasher as claimed in claim 1, wherein the comminution device includes at least one comminuting cutter, which can be set in motion by said lye pump, preferably in a rotational motion.

3. The dishwasher as claimed in claim 1, wherein said comminution device is disposed inside an outlet channel through which the washing liquid is pumped out of the dishwasher.

4. The dishwasher as claimed in claim 3, wherein with respect to the direction of flow of said washing liquid a sieve is arranged in said outlet channel behind said comminution device.

5. The dishwasher as claimed in claim 4, wherein said sieve is designed as a matrix, which cooperates with said comminution device to comminute said rinse residue in said outlet channel.

6. The dishwasher as claimed in claim 5, wherein said sieve designed as a matrix has a lattice structure, which essentially is formed from a resistant material, preferably metal, and is designed with sharp edges, which cooperate with said comminution device to comminute said rinse residue in said outlet channel.

7. The dishwasher as claimed in claim 4, including a second sieve arranged in said outlet channel before said comminution device with respect to the direction of flow of said washing liquid.

8. The dishwasher as claimed in claim 7, including said second sieve is a large-meshed sieve to hold back larger rinse residue.

9. The dishwasher as claimed in claim 4, wherein said comminution device includes at least one comminuting cutter, which can be set in motion by said lye pump, preferably in a rotational motion and said cutter is adjacent to or in contact with said sieve.

10. The dishwasher as claimed in claim 1, including the drive of said comminution device occurs via an impeller of said lye pump.

11. The dishwasher as claimed in claim 1, including the drive of said comminution device is established by way of a substantially rigid drive shaft.

12. The dishwasher as claimed in claim 11, including said drive shaft coupled onto the hub of an impeller of said lye pump between said comminution device and said lye pump.

13. A dishwasher, comprising a circulation pump for circulating washing liquid within the dishwasher;

a lye or discharge pump for pumping the washing liquid out of the dishwasher;

a comminution device for comminuting coarse rinse residue in said washing liquid as it is pumped out of said dishwasher;

said comminution device driven by said lye pump, said comminution device disposed inside an outlet channel through which the washing liquid is pumped out of said dishwasher;

wherein said comminution device includes at least one comminuting cutter, which can be set in motion by said lye pump, preferably in a rotational motion; and a sieve arranged in said outlet channel behind said comminution device with respect to the direction of flow of said washing liquid.

14. The dishwasher as claimed in claim 13, wherein said sieve is designed as a matrix, said matrix cooperating with said comminution device to comminute said rinse residue in said outlet channel.

15. The dishwasher as claimed in claim 14, wherein said sieve designed as a matrix has a lattice structure, which essentially is formed from a resistant material, preferably metal, and is designed with sharp edges, which cooperate with said comminution device to comminute said rinse residue in said outlet channel.

16. The dishwasher as claimed in claim 13, including a second sieve arranged in said outlet channel before said comminution device with respect to the direction of flow of said washing liquid.

17. The dishwasher as claimed in claim 16, including said second sieve is a large-meshed sieve to hold back larger size rinse residue.

18. The dishwasher as claimed in claim 13, wherein said cutter is adjacent to or in contact with said sieve.

19. The dishwasher as claimed in claim 13, including the drive of said comminution device occurs via an impeller of said lye pump.

20. The dishwasher as claimed in claim 19, including said drive of said comminution device is established by way of a substantially rigid drive shaft coupled to said impeller.

21. The dishwasher as claimed in claim 20, including said drive shaft connected onto a hub of said impeller of said lye pump between said comminution device and said lye pump.

22. A method of comminuting residue in a dishwasher, the dishwasher including a circulation pump and a lye or discharge pump, comprising:

pumping the washing liquid including residue therein out of said dishwasher by said lye or discharge pump; and comminuting said residue as it is being pumped out of said dishwasher by providing a comminution device that is driven by said lye or discharge pump.

23. The method as claimed in claim 22, including providing at least one cutter in said comminution device and driving said cutter in rotational motion with said discharge pump.

24. The method as claimed in claim 22, including pumping said washing liquid including residue therein out of said dishwasher through an outlet channel and providing said comminution device disposed in said outlet channel.

25. The method as claimed in claim 24, including providing a sieve for filtering said residue in said washing liquid located behind said comminution device in the direction of flow of said washing liquid.

26. The method as claimed in claim 25, including designing said sieve as a matrix and said sieve cooperating with said comminution device for comminuting said residue in said outlet channel.

27. The method as claimed in claim 26, including designing said matrix as a lattice structure, and forming said lattice structure from a resistant material having sharp edges for cooperating with said comminution device for comminuting said residue in said outlet channel.

28. The method as claimed in claim 25, including providing a second sieve for filtering said residue in said washing liquid located before said comminution device in the direction of flow of said washing liquid.

29. The method as claimed in claim 28, including forming said second sieve as a large-meshed sieve to hold back larger sized rinse residue.

30. The method as claimed in claim 25, including providing at least one comminuting cutter in said comminution device adjacent to or in contact with said sieve which is set in rotational motion by said discharge pump.

31. The method as claimed in claim 22, including driving said comminution device with an impeller provided with said discharge pump.

32. The method as claimed in claim 31, including providing a substantially rigid drive shaft coupled to said impeller for driving said comminution device.

33. The method as claimed in claim 32, including connecting said drive shaft coupled to a hub provided on said impeller between said comminution device and said discharge pump.

34. A dishwasher, comprising a circulation pump for circulating washing liquid within the dishwasher;

a lye or discharge pump for pumping the washing liquid out of the dishwasher through an outlet channel; and a comminution device for comminuting coarse rinse residue in said washing liquid as it is pumped through the outlet channel and out of said dishwasher by the lye pump; said comminution device set in motion by said lye pump.

* * * * *